United States Patent [19]

Carreker

[11] Patent Number: 4,461,078

[45] Date of Patent: Jul. 24, 1984

[54] STYLING RAZOR

[76] Inventor: Reginald V. Carreker, 4411 Fernhill Rd., Wheaton, Md. 20906

[21] Appl. No.: 344,715

[22] Filed: Feb. 1, 1982

[51] Int. Cl.[3] ..... B26B 21/00

[52] U.S. Cl. ..... 30/47; 30/50; 30/85

[58] Field of Search ..... 30/47, 49, 50, 32, 52, 30/299, 283, 85–89

[56] References Cited

U.S. PATENT DOCUMENTS 1,203,005 10/1916 Kattell ..... 30/32 UX 2,861,339 11/1958 Malecki ..... 30/32 X

*Primary Examiner*—E. R. Kazenske

*Assistant Examiner*—Douglas D. Watts

*Attorney, Agent, or Firm*—Cushman, Darby & Cushman

[57] ABSTRACT

A razor assembly includes first and second handle portions, with first and second razor heads mounted at the ends of the handle portions. The first razor head is adapted to mount a conventional-width razor cartridge, while the second razor head is adapted to mount a styling razor cartridge, the styling razor head having a width about one-third that of the regular razor cartridge. The handle portions are pivotally mounted together so that the heads may be moved from a position wherein the handle portions are substantially in a straight line with the heads widely spaced, to a position wherein the handle portions make a small acute angle with the heads close to each other. The cartridges mounted by the heads are always parallel, and the blades extending from the cartridges are disposed on the same side of the handle.

9 Claims, 5 Drawing Figures

Fig.3.
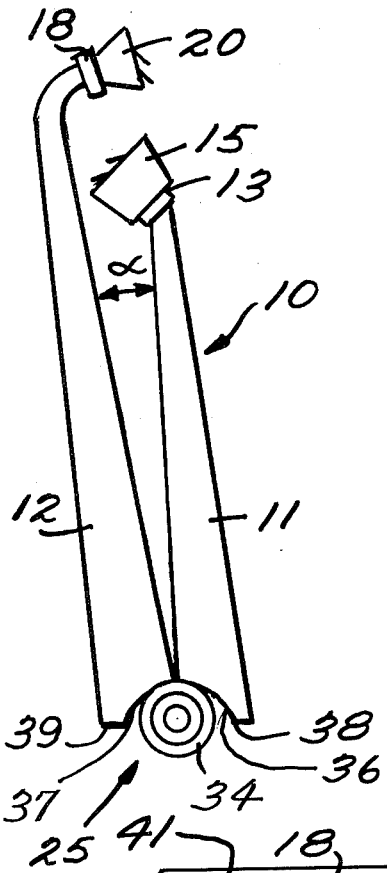
Fig.2.
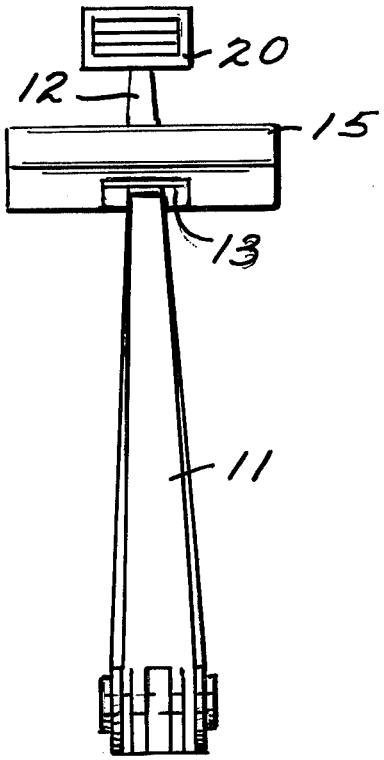
Fig.1.
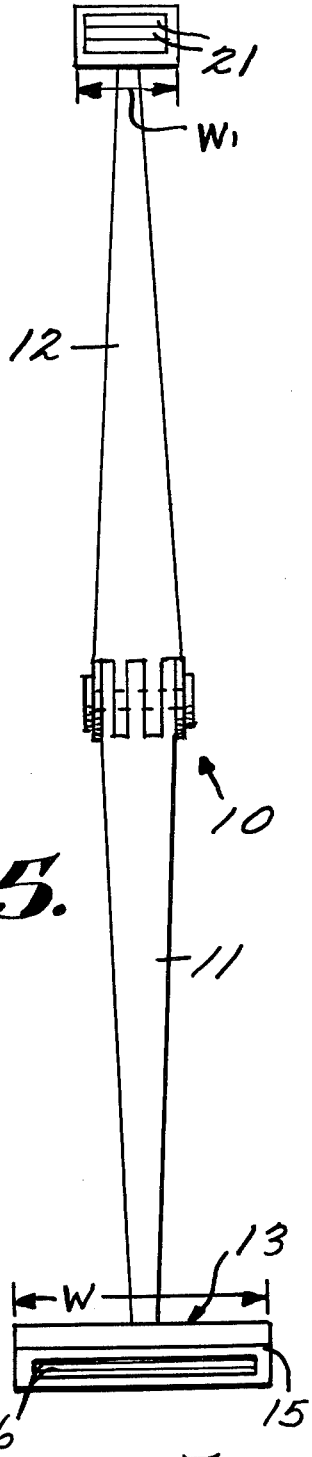
Fig.5.
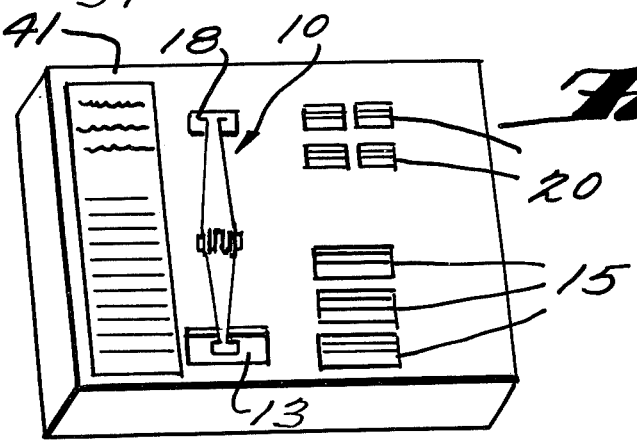
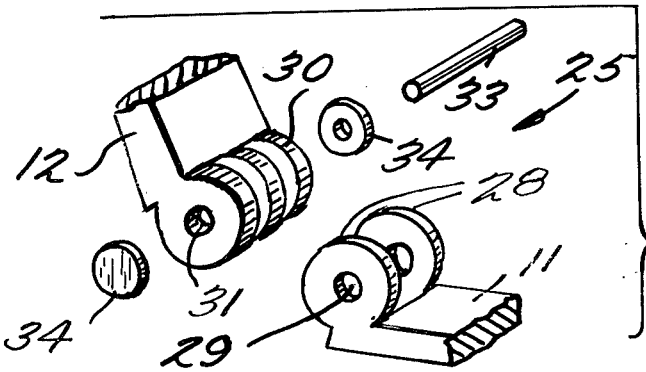
Fig.4.

STYLING RAZOR

BACKGROUND AND SUMMARY OF THE INVENTION

There are few implements on the market that are readily utilizable by the average consumer for styling facial hair. In order to properly effect styling of facial hair it is necessary to have a readily maneuverable shaving implement. Most manual and electric razors on the market are adapted for shaving the entire face, and are not easily utilizable for styling.

According to the present invention a razor assembly is provided that is emminently suited for styling, yet also is utilizable for shaving large areas of the face, as is done with conventional manual razors. The razor assembly according to the invention provides the convenience of both styling and clean-shaving in a single implement, which implement is also easy to store and transport. The razor assembly according to the invention is ideal both for normal shaving and for trimming styles of sideburns, beards, and moustaches, to give a desired appearance.

The razor assembly according to the invention includes a handle first portion, with a first razor head means mounted at one end of the handle first portion for holding a razor having a predetermined width w (e.g., a conventional width blade cartridge). A second handle portion includes a second razor head means mounted at one end thereof for holding a razor having a predetermined width W', wherein W' is substantially less than W (e.g., a blade cartridge having a width about one-third W). Interconnecting means are provided for connecting the handle first and second portions together. The interconnecting means include means for pivotally connecting the handle first and second portions so that razors held by the first and second head means are movable from a first position wherein they are parallel and spaced relatively widely from each other with the first and second handle portions substantially in a straight line, to a second position wherein they are parallel to each other and disposed right next to each other, with the first and second handle portions making a small acute angle.

Each razor preferably comprises a replaceable cartridge (such as a double edge cartridge) having one or more blade edges extending outwardly from one side thereof. The interconnecting means mount the handle portion so that the blade edges of the cartridges extending from the first and second heads are disposed on the same side of the handle, and when the heads are in the position close to each other the blade edges are directed toward each other. Stops formed integrally with the handle portions define the maximum-distance spacing between the heads.

The razor assembly according to the invention may be packaged with a plurality of styling and conventional cartridges for convenience.

It is the primary object of the present invention to provide a readily utilizable, simple razor assembly that can be utilized both for styling and normal shaving. This and other objects of the invention will become clear from an inspection of the detailed description of the invention, and from the appended claims.

BRIEF DESCRIPTION OF THE DRAWINGS

FIG. 1 is a front view of an exemplary razor assembly according to the present invention, with the heads disposed in a position for use during shaving;

FIG. 2 is a view like FIG. 1 only showing the assembly in a position for easy storage;

FIG. 3 is a side view of the assembly in a position for easy storage;

FIG. 4 is a detailed perspective view illustrating exemplary interconnecting means for the handle portions; and FIG. 5 is a perspective view of an exemplary package for mounting the razor assembly of FIG. 1 with a plurality of shaving cartridges.

DETAILED DESCRIPTION OF THE DRAWINGS

An exemplary razor assembly according to the present invention is indicated generally by reference numeral 10 in the drawings. The assembly includes a handle comprising a first handle portion 11 and a second handle 12. A first razor head means 13 is mounted at one end of the handle first portion 11 for holding a razor having a predetermined width W. Preferably the razor is in the form of a conventional replaceable cartridge 15, having one or more blades (e.g., two blades) with shaving edges 16 extending from one side thereof. Interconnection between the replaceable cartridge 15 and the head 13 can be in any conventional manner, such as shown in U.S. Pat. Nos. 3,832,774 and 4,026,016, the disclosures of which are incorporated by reference herein.

A second razor head means 18 is mounted at an end of the handle second portion 12, for holding a razor having a predetermined width W', wherein W' is substantially less than W. The razor held by the second razor head means 18 preferably also comprises a replaceable cartridge 20 having one or more blades with shaving edges 21 extending from one side thereof. Interconnection between the second head 18 and the cartridge 20 may be provided in the same manner as for the first head 13 and first cartridge 15.

Cartridge 15 is preferably a conventional commercially available cartridge, the width W being a conventional cartridge width (e.g., 1 9/16 inches). The blade edges 16 of the first cartridge 15 are utilized in normal shaving. The second cartridge 20 is dimensioned for easy maneuverability to facilitate styling of facial hair (e.g., sideburns, beards, and moustaches). The width W' is preferably about one-third the width W (as shown to scale in the drawings), which facilitates the styling function.

Means, shown generally by reference numberal 25, are provided for interconnecting the handle first and second portions 11, 12. The interconnecting means 25 preferably comprise means for pivotally connecting the handle first and second portions 11, 12 so that razors 15, 20 held by the first and second head means 13, 18, are movable from a first position (FIG. 1) wherein they are parallel and spaced relatively widely from each other, with the handle portions 11, 12 substantially in a straight line—to a second position (FIGS. 2 and 3) wherein the razors 15, 20 are parallel and disposed right next to each other, with the handle portions 11, 12 making a small acute angle $\alpha$ (see FIG. 3). In the first position (FIG. 1), the razors 15, 20 are disposed for use in shaving, while in the second position (FIGS. 2 and 3) they are disposed in a position for ready storage and/or transportation.

Preferably the interconnecting means 25 interconnect the handle portions 11, 12 so that the blade edges 16, 21 of the respective razors are disposed on the same side of the handle, and when pivoted into the second position (see FIG. 3) face generally toward each other.

The interconnecting means 25 may take a variety of forms, one exemplary form being illustrated most clearly in FIGS. 3 and 4. A plurality of circular plates 28—each containing a through extending opening 29—are connected to the first handle portion 11, while a plurality of similar circular plates 30—each with a through extending opening 31—are connected to the second handle portion 12. The plates 28, 30 of the respective handle portions 11, 12 are spaced in staggered relationship so that they are interleaved when moved in juxtaposition with the openings 29, 31 thereof in alignment. A pivot pin 33 passes through the openings 29, 31 when they are in alignment, and end caps 34 are provided for tightly receiving the ends of the pin 33 that extend outwardly from the plates 28, 30. The handle portions 11, 12 are provided with contoured surfaces 36, 37, respectively to allow relative pivotal action, with stops 38, 39 respectively formed integrally therewith for defining the first position (FIG. 1) of the handle portions 11, 12. Upon applying an appropriate force to the handle portions 11, 12, they may be pivoted about pivot pin 33 to move between the first and second positions thereof.

For convenience of sale and utilization of the razor assembly according to the invention, it may be packaged in the manner illustrated in FIG. 5. A common package body 41, such as a piece of styrofoam or the like, mounts the razor assembly 10 in cut-outs formed therein, and simultaneously mounts a plurality of razor cartridges 15 for use with the first head 13, and a plurality of styling razor cartridges 20 for use with the second head 18. The exact manner in which the cartridges 15, 20 are mounted is for ease of replacement and will be dictated by the exact mechanism used for interconnecting the cartridges and the heads.

As seen most clearly in FIGS. 2 and 3, the length of the handle portion 11 is preferably slightly less than the length of the handle portion 12 so that when they are in the collapsed (FIGS. 2 and 3) position the razors 15, 20 received by the heads 13, 18 do not interfere with each other.

The heads need not be the shape illustrated, for instance they may merely comprise journals, such as shown in U.S. Pat. No. 4,026,016.

In an exemplary manner of utilization of the razor assembly 10 according to the invention, the assembly 10 is removed from the package 41, a standard cartridge 15 is moved into operative association with the first head 13, and a styling cartridge 20 is moved into operative association with the second head 18. The user then grasps the handle 11, 12, with the assembly 10 in the position illustrated in FIGS. 1 and 5, and uses the razor 15 for shaving large areas of the face, and inverts assembly 10 and uses the razor 20 for trimming and styling other areas of the face. The razor 20 is especially useful in trimming sideburns, around moustaches, and around bearded portions of the face. When shaving is completed, the assembly 10 may be replaced in the packaging body 41, or a force may be applied to the handle portions 11, 12 pivoting them about an axis defined by pivot pin 33 so that they move toward each other to the position illustrated in FIGS. 2 and 3, and stored or transported in that position. Normal frictional action between the plates 28, 30 maintains the handle portions 11, 12 in any relative position to which they are moved, with the stops 38, 39 abutting each other to define the straight-line maximum open position (FIGS. 1 and 5) of the assembly 10.

It will thus be seen that according to the present invention a simple, effective and versatile razor assembly has been provided. While the invention has been herein shown and described in what is presently conceived to be the most practical and preferred embodiment thereof, it will be apparent to those of ordinary skill in the art that many modifications thereof may be made within the scope of the invention, which scope is to be accorded the broadest interpretation of the appended claims so as to encompass all equivalent structures and devices.

What is claimed is:

1. A razor assembly comprising:

a handle including first and second handle portions each elongated in a dimension of elongation;

a first razor head means mounted at one end of said handle first portion for holding a first razor having a cutting edge, said razor having a predetermined width W, so that said first razor edge is substantially perpendicular to said handle first portion dimension of elongation;

a second razor head means, mounted at one end of said handle second portion, for holding a second razor having a cutting edge, said second razor having a predetermined width W′, wherein W′ is substantially less than W so that said second razor edge is substantially perpendicular to said handle second portion dimension of elongation; and means for interconnecting said handle first and second portions.

2. An assembly as recited in claim 1 wherein said interconnecting means comprise means for pivotally connecting said handle first and second portions so that razors held by said first and second head means are movable from a first position, wherein they are parallel and spaced relatively widely from each other, with said first and second handle portions substantially in a straight line, to a second position, wherein razors held by said first and second head means are parallel and disposed right next to each other, with said first and second handle portions making a small acute angle.

3. An assembly as recited in claim 2 wherein each razor comprises a cartridge having said razor edge extending outwardly from one side thereof; and wherein said razor edges of said cartridges extend outwardly on the same side of said handle.

4. An assembly as recited in claim 3 wherein said interconnecting means further comprise means for connecting said handle portions so that in said second position said blade edges extend generally toward each other.

5. An assembly as recited in claim 1 or 3 wherein W′ equals about one-third W.

6. An assembly as recited in claim 5 wherein W equals about 1 9/16 inches.

7. An assembly as recited in claim 2 or 4 wherein said second handle portion is a length slightly less than said first handle portion so that when said portions are in said second position razors received by said first and second head means do not abut each other.

8. An assembly as recited in claim 3 wherein each cartridge includes two razors with parallel razor edges.

9. A razor assembly comprising:

a handle including first and second handle portions each elongated in a dimension of elongation;

a first razor head means mounted at one end of said handle first portion for holding a first razor having a cutting edge so that said first razor edge is substantially perpendicular to said handle first portion dimension of elongation;

a second razor head means, mounted at one end of said handle second portion, for holding a second razor having a cutting edge, so that said second razor edge is substantially perpendicular to said handle second portion dimension of elongation; and means for interconnecting said handle first and second portions, said interconnecting means comprising: means for pivotally connecting said handle first and second portions so that said razors held by said first and second head means are movable from a first position, wherein said razors are parallel and spaced relatively widely from each other, with said first and second handle portions substantially in a straight line, to a second position, wherein said razors held by said first and second head means are parallel and disposed right next to each other, with said first and second handle portions making a small acute angle; and means for connecting said handle portions so that in said second position said blade edges extend generally toward each other;

said second handle portion having a length slightly less than said first handle portion so that when said portions are in said second position said razors received by said first and second head means do not abut each other.

* * * * *